US005699780A

United States Patent [19]

Bissonnette

[11] Patent Number: 5,699,780

[45] **Date of Patent: *Dec. 23, 1997**

[54] HYDRAULIC IMPULSE SPEARGUN

[76] Inventor: Laurent C. Bissonnette, 160 Sea Meadow Dr., Portmouth, R.I. 02871

[ * ] Notice: The term of this patent shall not extend beyond the expiration date of Pat. Nos. 5,690,090 and 5,690,091.

[21] Appl. No.: 668,033

[22] Filed: Jun. 17, 1996

[51] Int. Cl.[6] ..... F41B 11/00

[52] U.S. Cl. ..... 124/69; 124/73

[58] Field of Search ..... 124/1, 56, 69, 124/73, 74, 75, 76, 80; 43/6; 102/399, 504; 273/416

[56] References Cited

U.S. PATENT DOCUMENTS

| | | | |
|---|---|---|---|
| 265,969 | 10/1882 | Lyon et al. | 102/504 |
| 267,027 | 11/1882 | Shaw | 102/504 X |
| 2,101,198 | 12/1937 | Robinson | 124/69 |
| 2,805,622 | 9/1957 | Cammin-Christy | 102/504 |
| 2,923,286 | 2/1960 | Draganti | 124/69 X |
| 3,669,087 | 6/1972 | Hamrick et al. | 124/74 |
| 3,717,947 | 2/1973 | Nomura | 124/73 X |
| 3,910,189 | 10/1975 | Whidden et al. | 102/504 X |
| 4,505,179 | 3/1985 | Nelson et al. | 102/504 X |
| 5,086,749 | 2/1992 | Ekstrom | 124/74 |
| 5,373,832 | 12/1994 | D'Andrade | 124/69 |
| 5,373,833 | 12/1994 | D'Andrade | 124/69 |
| 5,398,587 | 3/1995 | Kornblith | 102/504 X |

*Primary Examiner*—John A. Ricci

*Attorney, Agent, or Firm*—Michael J. McGowan; Robert W. Gauthier; Prithvi C. Lall

[57] ABSTRACT

A hydraulic speargun has an elongated elastomeric bladder for charging the gun. One end of the bladder selectively communicates with the breech chamber at the end of the gun barrel. The other end of the bladder is connected to a pump for inflating the bladder with water under pressure. A plug and dart assembly is breech loaded into the barrel. A trigger opens a valve to release the water pressure into the breech chamber. The pressure forces the spear ended dart portion of the plug and dart assembly to separate from the breech plug end and the dart portion is launched out the muzzle end of the barrel by the force of the water. A lanyard is attached between the breech plug end and the dart end and is coiled around the plug end. As the dart portion travels from the muzzle, the lanyard is deployed through the muzzle end of the barrel.

9 Claims, 3 Drawing Sheets

HYDRAULIC IMPULSE SPEARGUN

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED PATENT APPLICATIONS

This patent application is co-pending with related patent applications entitled SPEARGUN PROJECTILE ASSEMBLY (Ser. No. 08/668,035) and LANYARD RETAINER FOR A SPEARGUN PROJECTILE (Ser. No. 08/668,034) by the same inventor as this application.

BACKGROUND OF THE INVENTION (1) Field of the Invention

The present invention relates to underwater spearguns, and deals more particularly with a hydraulically operated impulse gun especially suited to loading underwater. The kinetic energy for launching the spear or projectile from the gun is provided by the release of fluid under pressure from an elastomeric energy storing device.

(2) Description of the Prior Art

Underwater guns of the type used to spear fish generally provide for some form of elastic or pneumatic catapult system. In the elastic catapult a long spear is launched by means of a stretched elastic band. The elastic band is stretched and attached to the spear. The spear is prevented from moving by a trigger mechanism. When the trigger is actuated, the elastic band contracts and catapults the spear from the gun. Stretching the rubber band and attaching it to the spear is a difficult task, especially when done while swimming. Loading these spearguns becomes a dangerous task which often results in cuts and bruises.

In the pneumatic catapult type of speargun, an air spring is provided for launching the projectile. The speargun is loaded by forcing the spear or a special loading pole against an air piston, compressing the air behind the piston. Accidental release of the loading pole or spear before the trigger mechanism has secured the air piston often results in injury.

Both the elastic and pneumatic catapult spearguns are muzzle loaded and require physical strength and dexterity for safe operation while swimming. The spearguns can be loaded on land where accidental discharge may cause fatal injuries. Without fluid resistance, the spear can travel at high speeds for great distances. The spears are typically attached to the guns by lanyards such that fish or the spear itself can be retrieved when the gun is discharged in water. The length of the lanyard is matched to the maximum flight of the spear in water. When the spear is discharged in the air, the longer flight of the spear pulls the lanyard taught and may cause the spear to recoil back towards the gun and user. Further, the lanyards on present spearguns are most often coiled along the gun barrel. When the gun is discharged, the coiled lanyard unravels rapidly and may easily entangle the gun operator. Finally, the typical spear used is a long thin cylindrical shaft. The hydrodynamic characteristics of this geometry limit the range and precision of present spearguns.

In my prior U.S. Pat. No. 4,848,210 entitled ELASTOMERIC IMPULSE ENERGY STORAGE AND TRANSFER SYSTEM, a generally spherical shaped bladder is pressurized with water to provide potential energy in the form of a working fluid for launching a projectile from a submarine when the pressure is released. An alternative use suggested for the bladder was for powering a speargun.

SUMMARY OF THE INVENTION

Accordingly, it is a general purpose and object of the present invention to provide a speargun which may be easily loaded while underwater.

It is a further object of the present invention to provide a speargun with a firing mechanism that allows only underwater loading to prevent accidental firing in air during the loading process.

Another object is to provide a speargun which can be breech loaded for increased safety. A further object is to provide a speargun with a lanyard system which does not expose the speargun operator to entanglement with the lanyard. A still further object is to provide a speargun with a projectile having improved hydrodynamic characteristics for greater range and precision when compared to present speargun projectiles.

These objects are accomplished with the present invention by providing a speargun with the barrel having a breech end containing a removable breech plug such that the projectile or spear can be loaded from the breech end rather than from the muzzle end. The barrel has an internal chamber for receiving a projectile, and the barrel is attached to a stock adjacent the breech end which stock defines a passageway communicating with the breech end of the barrel. The generally spherical bladder of my previous invention has been adapted for firing the projectile from the barrel. The bladder takes the shape of an elongated elastomeric tubular bladder which is provided immediately adjacent to the barrel and in generally parallel relationship thereto. The opposite ends of the tubular bladder define openings, one of which communicates with the passageway in the stock and the other end of which communicates with a pumping device also secured to the barrel. The pumping device preferably comprises a fixed pump tube and a pump slide arranged coaxially with respect to the tubular bladder. The speargun is charged for firing by holding the gun underwater and moving the pump slide back and forth along its axis. One way check valves are provided on opposite ends of this assembly so that water is admitted to the pump as the pump slide is moved in one direction, and so that water is provided under pressure to the interior of the tubular bladder as the pump slide is operated in the opposite direction.

Once the elastomeric tubular bladder has been inflated with water under pressure, a control valve, operated by a conventional style trigger, provides water under pressure from the bladder through the passageway in the stock into the breech end of the barrel with the result that the projectile is forcibly ejected from the open or muzzle end of the barrel. The lanyard secured to the projectile is payed off from a portion of the breech plug provided for this purpose in the breech end of the barrel. The payout of the lanyard is contained within the barrel such that the speargun operator cannot become entangled with the lanyard. The shape of the projectile and its trajectory through the barrel results in improved range and precision over conventional speargun projectiles.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings wherein.

DESCRIPTION OF THE PREFERRED EMBODIMENT

Figure 1:
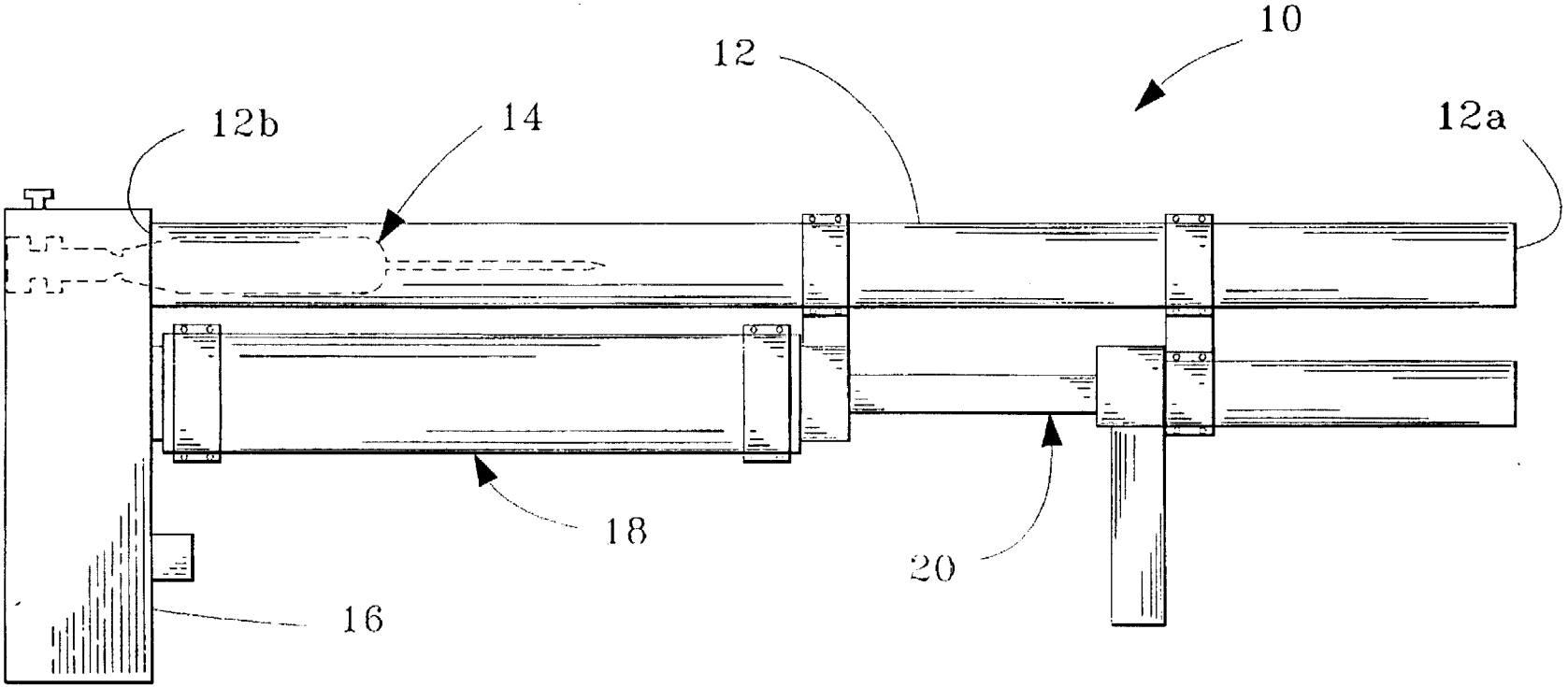
FIG. 1 shows the preferred form for a speargun constructed in accordance with the present invention.
Figure 2:
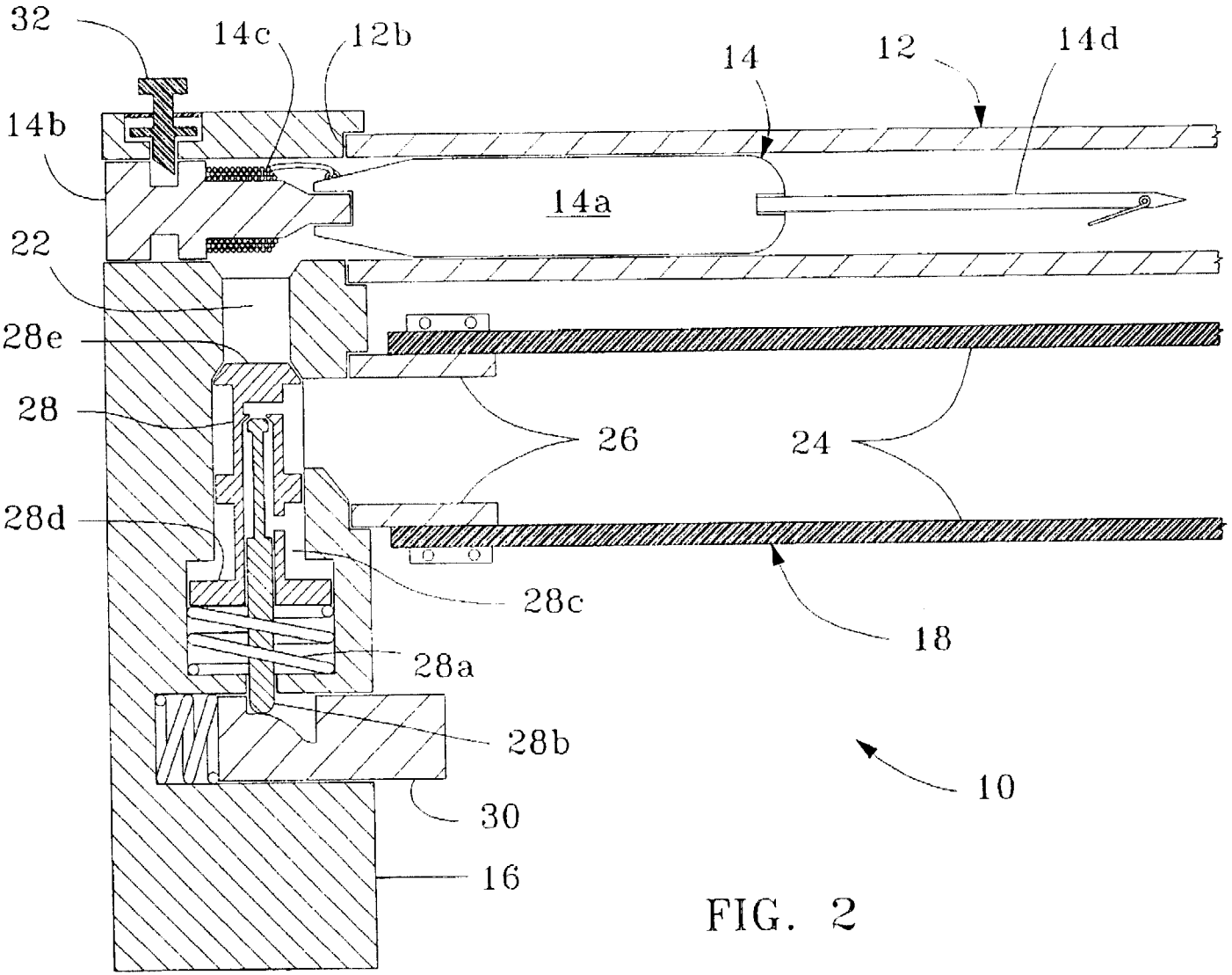
FIG. 2 shows a detail vertical section of the stock end of the speargun of the present invention.

Referring now to FIG. 1, a speargun 10 is illustrated as comprising a barrel 12, having a muzzle end 12*a* and an opposite breech end 12*b*, the latter being closed by a plug and dart assembly 14 shown in phantom. Barrel 12 is secured to stock 16. Elastomeric bladder assembly 18 is secured to stock 16 at one end and is supported on the other end by pump mechanism 20. Pump mechanism 20 is attached to barrel 12. Referring now additionally to the partial detailed cross section of the stock 16 end of speargun 10 shown in FIG. 2, stock 16 defines a passageway 22 having one end communicating with breech end 12*b* of barrel 12 and the other end in communication with elastomeric bladder assembly 18. Bladder assembly 18 consists of tubular bladder 24 secured at one end to short tube 26, which in turn is secured to stock 16. Control valve 28 is provided in passageway 22 and is biased by spring 28*a* toward the closed position as shown. Movable trigger 30 is provided in stock 16 and is mechanically linked to control valve 28 such that pressing trigger 30 towards stock 16 allows poppet 28*b* to move downward. The downward movement of poppet 28*b* allows fluid under pressure within tubular bladder 24 to enter valve passage 28*c* which exerts pressure against valve base 28*d*. This pressure overcomes spring 28*a* bias, moving valve seat 28*e* downwards, opening passageway 22 and allowing pressurized fluid into breech end 12*b*. Pressurized fluid acting on plug and dart assembly 14 causes dart 14*a* to separate from plug end 14*b* and be ejected from muzzle end 12*a* (not shown on FIG. 2) with great force. A snap joint is preferably provided between plug end 14*b* and dart 14*a* so as to avoid loss of dart 14*a* during handling and prior to firing of speargun 10. The snap joint is made such that the force of the water from tubular bladder 24 will overcome the limited frictional forces required to retain the projectile in the position shown. Lanyard 14*c* is secured to and coiled around a forward portion of plug end 14*b*. The other end of lanyard 14*c* is secured to dart 14*a* from which spear end 14*d* protrudes. A release mechanism is provided for plug end 14*b* as illustrated generally at 32. Plug end 14*b* is preferably buoyant so as to be readily retrieved when released from barrel 12 in the event that speargun 10 is to be reloaded quickly.

Figure 3:
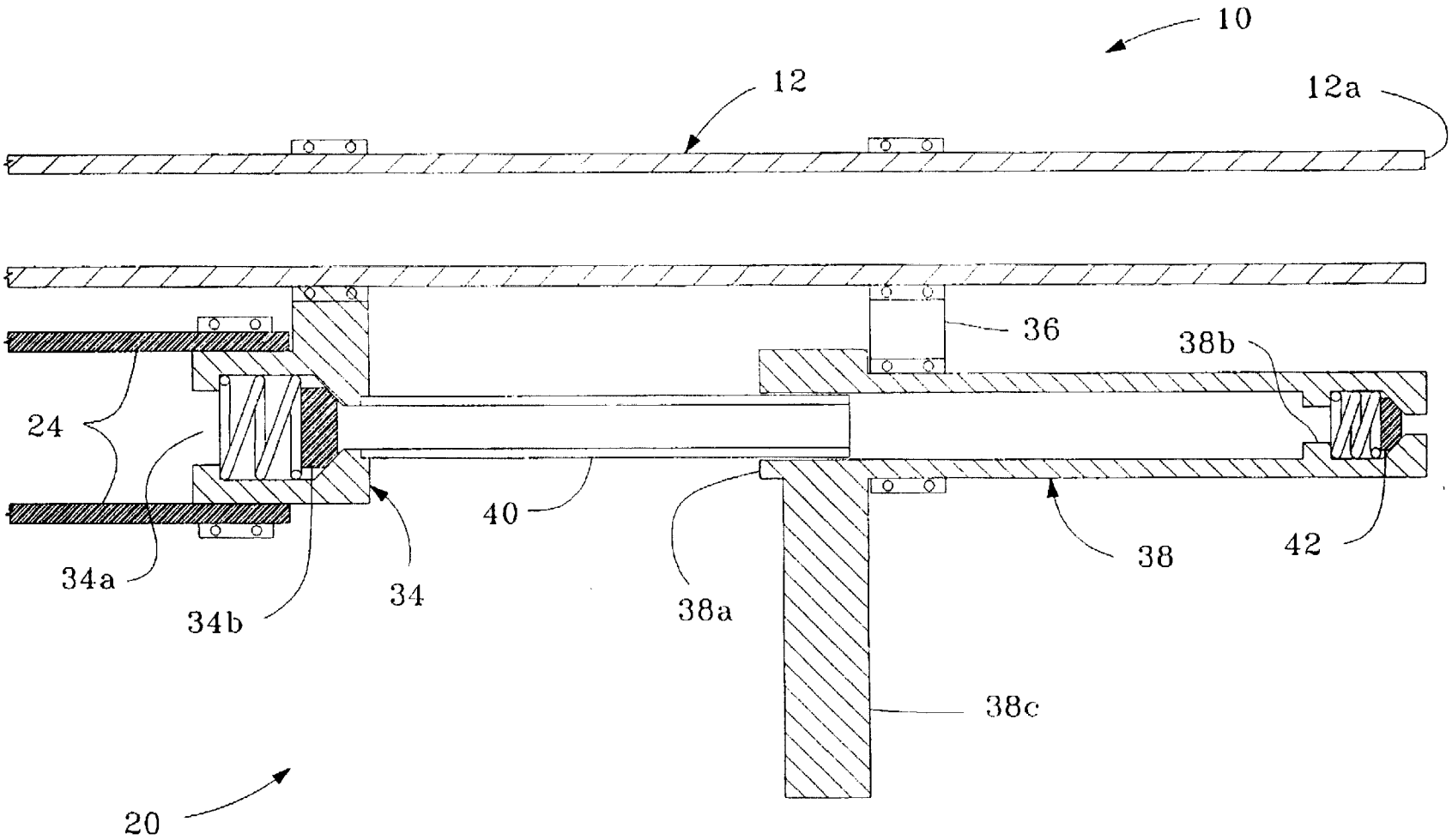
FIG. 3 shows a detail vertical section of the elastomeric tubular bladder and pumping device of the present invention.

Referring now additionally to the partial detailed cross section of the pump mechanism 20 of speargun 10 shown in FIG. 3 a fixed pump support 34 is provided between the muzzle end 12*a* and the breech end 12*b* (not shown in FIG. 3) of barrel 12 and serves to support the end of tubular bladder 24 removed from stock 16 (not shown on FIG. 3). Support 34 defines an inlet passageway 34*a* in which is provided first one way check valve 34*b*. Pump guide 36 slidably supports pump slide 38 which is coaxially received on fixed pump tube 40 at its first end 38*a*. Pump tube 40 is secured to support 34 and serves as a conduit for fluid communication between pump slide 38 and inlet passageway 34*a*. Second one way check valve 42 is provided within inlet end 38*b* of pump slide 38. Moving slide 38 in a direction away from stock 16 closes first check valve 34*b* and opens second check valve 42 admitting water into pump slide 38 and fixed pump tube 40. Moving slide 38 in the opposite direction, or towards stock 16, closes second check valve 42 and opens first check valve 34*b* causing water to enter tubular bladder 24 under pressure. Slide 38 has a pistol grip portion 38*c* to facilitate movement of slide 38. Suitable seals, such as o-rings, are provided between barrel 12 and assembly 14, between valve 28, base 28*d* and stock 16 and between pump slide 38 and pump tube 40.

In use, the user may have several plug and dart assemblies 14. Upon entering the water the user will breech load assembly 14 by pulling release mechanism 32 and pushing plug and dart assembly 14 into breech end 12*b* of the barrel 12. With speargun 10 loaded, the diver or user can then conveniently charge the gun. This is accomplished with one hand on pistol grip 38*c* and the other on stock 16. The hand on pistol grip 38*c* is pulled back then pushed forward several times. This action forces water to be pumped into tubular bladder 24. Speargun 10 is now charged and ready for firing. Depressing trigger 30 causes pressurized fluid to enter breech end 12*b* of barrel 12, launching dart 14*a* from muzzle 12*a* as previously described. The plug end 14*b* remains in barrel 12 and lanyard 14*c* deploys so as to permit retrieving the spear after it has been fired. If the user wishes to reload, he may pull up on release mechanism 32 and pull plug end 14*b* through barrel 12 by the attached lanyard 14*c*. The buoyant plug end 14*b* permits dart 14*a* and anything struck by spear end 14*d* to be conveniently retrieved. The diver preferably has several plug and dart assemblies 14 so as to permit him to load and fire the gun several times before retrieving his equipment and any catch obtained from use of the device.

What has thus been described is a hydraulic speargun having an elastomeric bladder assembly for charging the gun. A simple slide pump is used to pressurize the bladder with water. A trigger mechanism releases the pressurized water into the breech end of the barrel of the gun. The pressurized fluid forces a spear ended dart portion of a breech loaded plug and dart assembly to separate from the breech plug end and the dart portion is launched out the muzzle end of the barrel by the force of the water. A lanyard is attached between the breech plug end and the dart end and is coiled around the plug end. As the dart portion travels from the muzzle, the lanyard is deployed through the muzzle end of the barrel.

The speargun shown and described herein is much safer and easier to load and to use then present elastic or pneumatic spearguns. The breech plug and dart assembly can be loaded into the gun without charging the firing mechanism. Charging the speargun for firing requires a simple back and forth pumping action. There is less likelihood of accidental firing in air since the gun may not be charged unless the pump mechanism is submerged in water. Stowage of the lanyard within the barrel prevents entanglement and is inherently safer than present designs. The dart assemblies with the buoyant retainers or breech plugs facilitate rapid firing and reloading of the present speargun. The dart portion is compact and can be shaped for increased range and precision.

Obviously many modifications and variations of the present invention may become apparent in light of the above teachings. For example, the exact shapes and configurations of the particular components shown can be changed to suit manufacturing and assembly considerations. The pump slide may be replaced with any hand operated mechanism for pressurizing the bladder. A sliding piston could be connected to a handle which can be rotated back and forth to achieve the same result. The trigger mechanism could be fitted with a locking mechanism to prevent accidental firing. The trigger mechanism itself could be replaced with any convenient means for quickly releasing the pressurized fluid from the bladder into the breech end of the barrel.

In light of the above, it is therefore understood that within the scope of the appended claims, the invention may be practiced otherwise than as specifically described.

What is claimed is:

1. An underwater gun for firing a projectile comprising:

a barrel having a breech end, a muzzle end and an internal chamber adapted to receive a projectile;

a stock secured to said barrel adjacent the breech end and defining a passageway communicating with said barrel internal chamber;

an elongated elastomeric bladder having generally opposed openings, the first of said bladder openings communicating with said passageway defined by said stock, a first end of said bladder secured to said stock;

means for pumping water into said bladder via the second of said bladder openings;

a pump guide secured to said barrel for supporting said pumping means and a second end of said bladder; and control valve means in said passageway for selectively closing and opening said passageway to release water under pressure inside said bladder means into said breech end of said barrel to fire said projectile.

2. The gun of claim 1 wherein said pumping means comprises:

a tube having two generally opposing ends, the first of said ends being supported by said pump guide and having a first one way check therein, said first tube end associated with the second of said bladder openings; and a pump slide mounted for slidable movement along said tube, said pump slide having a slide end communicating with the second end of said tube, said pump slide having a valve end remote from said slide end, said valve end having a second one way check valve therein.

3. The gun of claim 1 wherein said elastomeric bladder is generally tubular having first and second tubular ends corresponding to said first and second bladder openings.

4. The gun of claim 3 wherein said pumping means comprises:

a tube having two generally opposing ends, the first of said ends being supported by said barrel and having a first one way check therein, said first tube end associated with the second of said bladder openings; and a pump slide mounted for slidable movement along said tube, said pump slide having a slide end communicating with the second end of said tube, said pump slide having a valve end remote from said slide end, said valve end having a second one way check valve therein.

5. The gun of claim 4 further characterized by a breech plug, and means for removably mounting said plug in the breech end of said barrel.

6. The gun of claim 5 further characterized by a movable trigger in said stock, and means mechanically linking said trigger to said control valve means.

7. The gun of claim 6 further characterized by lanyard storing means provided on said breech plug.

8. The gun of claim 1 further characterized by a breech plug, and means for removably mounting said plug in the breech end of said barrel.

9. The gun of claim 1 further characterized by a movable trigger in said stock, and means mechanically linking said trigger to said control valve means.

* * * * *